US010806321B2

(12) United States Patent
McMann, Jr. et al.

(10) Patent No.: US 10,806,321 B2
(45) Date of Patent: Oct. 20, 2020

(54) CLEANING TOOL

(71) Applicants: GOLDEN VENTURES, INC., Indianapolis, IN (US); Models, LLC, Lebanon, IN (US)

(72) Inventors: Larry R. McMann, Jr., Lebanon, IN (US); Gerard W. Golden, Carmel, IN (US); Christopher D. I. Miller, Zionsville, IN (US); Jerry J. Cason, Avon, IN (US)

(73) Assignees: Golden Ventures, Inc., Indianapolis, IN (US); Models, LLC, Lebanon, IN (US)

( * ) Notice: Subject to any disclaimer, the term of this patent is extended or adjusted under 35 U.S.C. 154(b) by 503 days.

(21) Appl. No.: 15/034,925

(22) PCT Filed: Nov. 20, 2014

(86) PCT No.: PCT/US2014/066560
§ 371 (c)(1),
(2) Date: May 6, 2016

(87) PCT Pub. No.: WO2015/077422
PCT Pub. Date: May 28, 2015

(65) Prior Publication Data

US 2016/0316985 A1 Nov. 3, 2016

Related U.S. Application Data

(60) Provisional application No. 61/906,494, filed on Nov. 20, 2013.

(51) Int. Cl.

| | |
|---|---|
| ***A47L 13/16*** | (2006.01) |
| ***A47L 13/46*** | (2006.01) |
| ***A47L 13/44*** | (2006.01) |

(52) U.S. Cl.
CPC ..... *A47L 13/16* (2013.01); *A47L 13/44* (2013.01); *A47L 13/46* (2013.01)

(58) Field of Classification Search
CPC ..... A47L 13/16; A47L 13/44; A47L 13/46; A47L 13/34; A47L 13/254; A47L 13/256; A47K 7/028
(Continued)

(56) References Cited

U.S. PATENT DOCUMENTS

| | | | |
|---|---|---|---|
| 825,400 | A | 7/1906 | Lightbown |
| 1,367,293 | A | 2/1921 | Brandes |

(Continued)

FOREIGN PATENT DOCUMENTS

| | | | |
|---|---|---|---|
| JP | S476663 | U | 9/1972 |
| JP | S5081650 | U | 7/1975 |

OTHER PUBLICATIONS

European Patent Office, Extended European Search Report, Application No. 14863632.7, dated Jul. 19, 2017.

(Continued)

*Primary Examiner* — Laura C Guidotti
(74) *Attorney, Agent, or Firm* — Quarles & Brady LLP

(57) ABSTRACT

A cleaning tool comprising a handle assembly and a pad assembly. The pad assembly is coupled to the handle assembly such that the handle assembly extends distally beyond a first end of the pad assembly. The pad assembly includes a pad securing surface having a plurality of pad securing members extending substantially perpendicularly from the pad securing surface, and a slotted member located at a second end of the pad assembly, the second end being opposite the first end. The slotted member defines a slot configured to accept a cleaning pad, and the slotted member extends at an angle from the pad securing surface.

12 Claims, 5 Drawing Sheets

(58) Field of Classification Search
USPC ..... 15/231
See application file for complete search history.

(56) References Cited

U.S. PATENT DOCUMENTS

| | | | | |
|---|---|---|---|---|
| 3,239,866 | A * | 3/1966 | Czerniawski | A47L 13/255 15/146 |
| 3,419,930 | A * | 1/1969 | Grunert | A47L 13/146 15/119.2 |
| 3,820,905 | A | 6/1974 | Sims | |
| 4,059,864 | A | 11/1977 | Spresny | |
| 4,069,537 | A * | 1/1978 | Matsuo | A46B 5/00 15/160 |
| 4,071,983 | A * | 2/1978 | Thielen | A47L 13/34 15/229.13 |
| 4,244,075 | A | 1/1981 | Silver | |
| 5,410,772 | A * | 5/1995 | Lewis | A47L 13/20 15/106 |
| 5,426,809 | A * | 6/1995 | Muta | A47L 13/254 15/228 |
| 5,426,810 | A | 6/1995 | Rones | |
| 5,524,314 | A | 6/1996 | Dickinson et al. | |
| 8,438,687 | B2 * | 5/2013 | Cybulski | A47J 37/0786 15/111 |
| 2009/0038092 | A1 * | 2/2009 | Kennedy | A47L 13/022 15/104.94 |
| 2009/0255075 | A1 * | 10/2009 | Carlson | A47L 13/34 15/104.94 |

OTHER PUBLICATIONS

International Search Report and Written Opinion dated Feb. 19, 2015 in connection with PCT/US2014/0665460.

* cited by examiner

CLEANING TOOL

CROSS REFERENCE TO RELATED APPLICATIONS

This application is a 371 application of PCT/US2014/066560 filed Nov. 20, 2014 which claims the benefit of United States Provisional patent application Ser. No. 61/906,494, filed Nov. 20, 2013, the disclosures of which are hereby incorporated by reference for all purposes

FIELD OF THE INVENTION

This invention relates to a tool for holding and using a replaceable cleaning pad.

BACKGROUND OF THE INVENTION

In the area of household and commercial cleaning, a need may arise for the use of an abrasive surface for the removal of dirt, grime or other surface residue. Often a non-woven cleaning pad may be used; however, one problem with the use of a non-woven cleaning pad is that direct skin-to-pad contact may abrade or irritate skin over prolonged use. Further, chemical cleaners are often added to the non-woven pad for added cleaning strength. These added chemical cleaners may come in contact with skin, nails, etc. of the user and can cause negative impacts such as allergic reactions and damage to nail polish. Thus many tools exist on the market to allow a user to make use of a non-woven cleaning pad without directly contacting such a pad or any chemical cleaner that has been applied to it. However, these tools can require that the non-woven cleaning pad be spread out over a large area, thereby reducing the cleaning force that can be applied to the pad.

While a variety of devices and means for holding a cleaning pad have been made and used, it is believed that no one prior to the inventor(s) has made or used an invention as described herein.

SUMMARY OF THE INVENTION

One embodiment provides a cleaning tool comprising a handle assembly and a pad assembly. The pad assembly is coupled to the handle assembly such that the handle assembly extends distally beyond a first end of the pad assembly. The pad assembly comprises a pad securing surface having a plurality of pad securing members extending substantially perpendicularly from the pad securing surface. A slotted member is located at a second end of the pad assembly, the second end being opposite the first end. The slotted member defines a slot configured to accept a cleaning pad, wherein the slotted member extends at an angle from the pad securing surface.

Another embodiment provides a cleaning tool comprising a handle assembly and a pad assembly. The pad assembly is coupled to the handle assembly such that the handle assembly extends distally beyond a first end of the pad assembly. The pad assembly comprises a pad securing surface having a plurality of pad securing members extending substantially perpendicularly from the pad securing surface. A slotted member is located at a second end of the pad assembly. The slotted member extends at an angle from the pad securing surface. The slotted member includes a slot configured to accept a cleaning pad, and the slot includes an open end at a first side of the tool and a closed end at a second opposite side of the tool.

Another embodiment provides a cleaning tool comprising a handle assembly and a pad assembly. The pad assembly is coupled to the handle assembly such that the handle assembly extends distally from the pad assembly. The pad assembly comprises a pad securing surface having a plurality of pad securing members extending substantially perpendicularly from the pad securing surface. A slotted member is located at a first end of the pad assembly. The slotted member extends at an angle from the pad securing surface. The slotted member includes a slot configured to accept a cleaning pad and includes an open end at a first side of the tool and a closed end at a second opposite side of the tool.

BRIEF DESCRIPTION OF THE DRAWINGS

While the specification may conclude with one or more claims that particularly point out and distinctly claim the invention, it is believed the present invention will be better understood from the following description of certain examples taken in conjunction with the accompanying drawings, in which like reference numerals identify the same elements.

Figure 1:
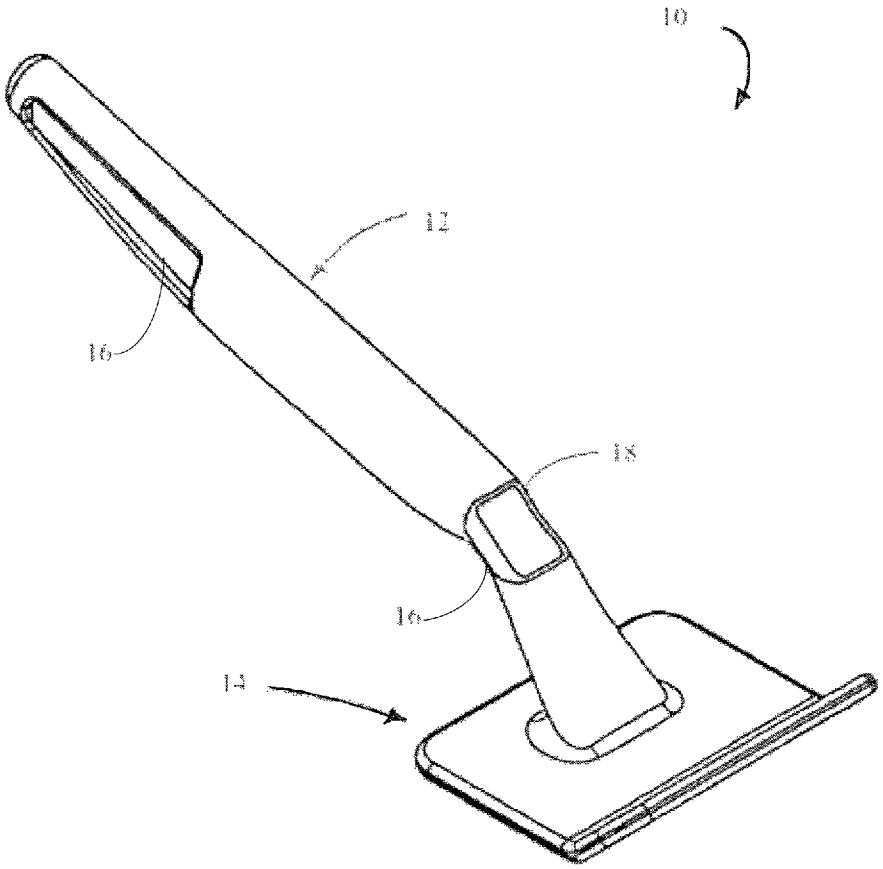
FIG. 1 depicts an isometric view of an exemplary cleaning tool, showing a handle assembly and a cleaning pad assembly.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION OF THE PREFERRED EMBODIMENT

The following description of certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. Accordingly, the drawings and descriptions should be regarded as illustrative in nature and not restrictive.

FIG. 1 illustrates an exemplary cleaning tool 10. Cleaning tool 10 comprises handle assembly 12 and pad assembly 14. As is shown, cleaning tool 10 is a unitary design with handle assembly 12 and pad assembly 14 being a single piece of the same material. However, other designs may be used wherein handle assembly 12 and pad assembly 14 can be distinct parts connected by a mechanical fastener, an adhesive bond, or another type of bonding process or attachment technique.

Moreover, handle assembly 12 and pad assembly 14 may be constructed of distinct materials.

In the present example, both handle assembly 12 and pad assembly 14 can be comprised of a thermoplastic material such as HDPE or ABS. However, any suitable material may be used, such as wood, metal or metallic alloy. Additionally, other types of plastic or polymer materials can be used. Other materials from which handle assembly 12 and pad assembly 14 can be made will be obvious to those of ordinary skill in the art.

FIG. 1 depicts handle assembly 12 as generally cylindrical in shape with a slight contour from one end of the handle assembly to the other. Any other suitable shape may be utilized for the construction of handle assembly. In other embodiments, handle assembly 12 may have a cross-sectional shape that is generally triangular, square, hexagonal or any other cross-sectional shape that may occur to those of skill in the art in view of this disclosure. Handle assembly 12 can extend distally from pad assembly 14 at a first angle relative to pad assembly 14. As handle assembly 12 extends distally, the first angle can shift to a second angle lesser than the first angle. Handle assembly 12 should not be limited to any particular angle relative to pad assembly 14. Nor should handle assembly be limited to shifting between any angles relative to pad assembly 14 as handle assembly 12 extends distally beyond the rearward end of pad assembly 14. Indeed, other embodiments may utilize a single angle, different angles, or several angles relative to pad assembly 14. Further, handle assembly 12 can have an elbow portion 18. Elbow portion 18 can change the angle of the handle assembly 12 from the first angle relative to the pad assembly 13. In one example, the elbow portion 18 can change the first angle of the handle assembly 12 to a second angle less than the first angle, relative to the pad assembly 13. Alternatively, the elbow portion 18 can change the first angle of the handle assembly 12 to a second angle greater than the first angle, relative to the pad assembly 13. In addition, handle assembly 12 is shown with a plurality of gripping surfaces 16. In one embodiment, the plurality of gripping surfaces 16 can be voids. Alternatively, the plurality of gripping surfaces 16 can include raised ribbed features. Other examples may include gripping surfaces 16 of different shapes, sizes and configurations that will be obvious to those of ordinary skill in the art.

Figure 2:
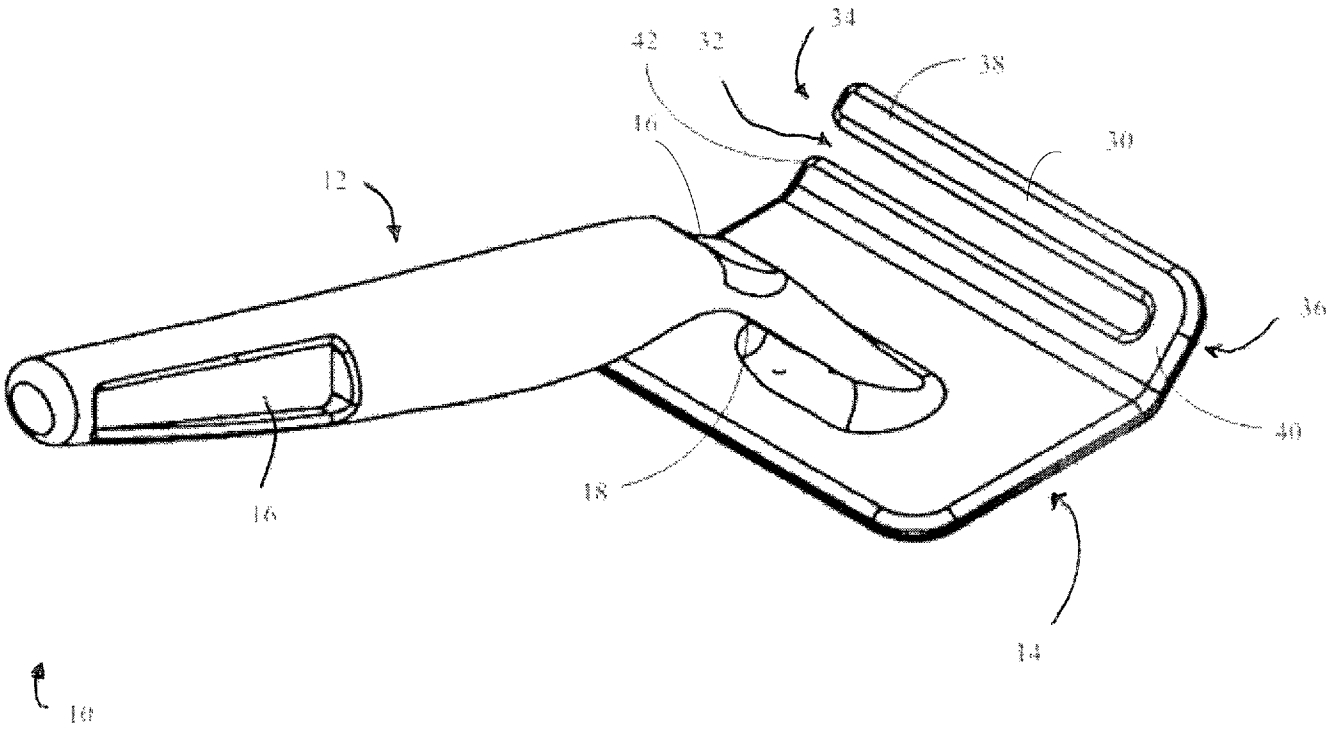
FIG. 2 depicts a perspective view of the exemplary cleaning tool, showing the handle assembly and a cleaning pad slot.

FIG. 2 depicts the exemplary cleaning tool 10 from a different angle relative to FIG. 1, showing a slotted member 30 integrated into pad assembly 14. Slotted member 30 extends upwardly at an angle to planar portion of pad assembly 14 at the forward end of pad assembly 14. Additionally slotted member 30 is shown with a slot 32 extending substantially from one side of pad assembly (14) to the other along the width of the pad assembly 14. Slotted member 30 can extend across the entire width of the pad assembly 14 and can create a space, such that the slot 32 can be open at one end and closed at the other end. In one embodiment slot 32 can terminate at an open end 34 on one side of the slotted member 30 and a closed end 36 on an opposite side of the slotted member 30. The slotted member 30 can also include arm member 38, transverse member 40 and base member 42. The transverse member 40 can extend along an axis substantially perpendicular to an axis of the arm member 38 and base member 42. Additionally, the transverse member 40 can define the closed end 36.

Closed end 36 can allow slotted member 30 to maintain rigidity such that a cleaning pad (not shown) may be held in place by slot 32. In one embodiment, the cleaning pad can be a non-woven cleaning pad. For example, the cleaning pad can be an abrasive non-woven cleaning pad such as those sold by Cerama Bryte, Inc., located at PO Box 781343, Indianapolis, Ind. Alternatively, the cleaning pad can be an abrasive non-woven cleaning pad. Additionally, other types of cleaning pads such as woven cleaning pads and/or closed cell cleaning pads could be used. Open end 34 of slot 32 can permit a cleaning pad (not shown) to be inserted into slot 32. In one embodiment, the cleaning pad (not shown) can be inserted into slot 32 by sliding a first edge of the cleaning pad (not shown) into the open end 34 of slot 32. The cleaning pad (not shown) can then be moved laterally such that the first edge of the cleaning pad (not shown) is placed adjacent to the closed end 36 of slot 32.

In one embodiment, slot 32 can have a width which allows for pressure to be placed on a cleaning pad (not shown) once inserted into the slotted member 30. The cleaning pad (not shown) may be compressed sufficiently to keep the cleaning pad (not shown) from falling out of the slot 32, but not so much as to substantially hinder its removal or the adjustment of its position in the slot 32. The thickness can be defined by the transverse member 40. The pressure can be accomplished by sizing the slot 32 to be approximately the same width as the thickness of the cleaning pad (not shown), such that there is slight compression when the cleaning pad (not shown) in inserted into the slotted member 30 between the arm member 38 and the base member 42. This compression can secure the cleaning pad (not shown) such that the cleaning pad (not shown) can be less likely to be displaced from slot 32 during use. In one embodiment, the width of the slot 32 can be less than the thickness of the cleaning pad (not shown). For example, the width of the slot 32 can be about 3% smaller to about 8% smaller than the thickness of the cleaning pad (not shown), or more or less. In one embodiment, the width of the slot 32 can be about 0.5 centimeters. However, it should be known that the width of the slot 32 can be more than 0.5 centimeters, or less than 0.5 centimeters.

Slot 32 is shown with a certain transverse size. However, many transverse sizes may be suitable. A suitable size can depend on the material used to construct slotted member 30 and the type of non-woven cleaning pad (not shown) used. Likewise the size and shape of closed end 36 may be of any suitable size or shape as dictated by the slotted member 30 material and the non-woven cleaning pad (not shown) to be used. Various size and shape combinations regarding the slotted member 30 will be obvious to those with ordinary skill in the art. In one embodiment, the slotted member 30 can be located on the end of pad assembly 14 opposite the handle assembly 12.

Figure 3:
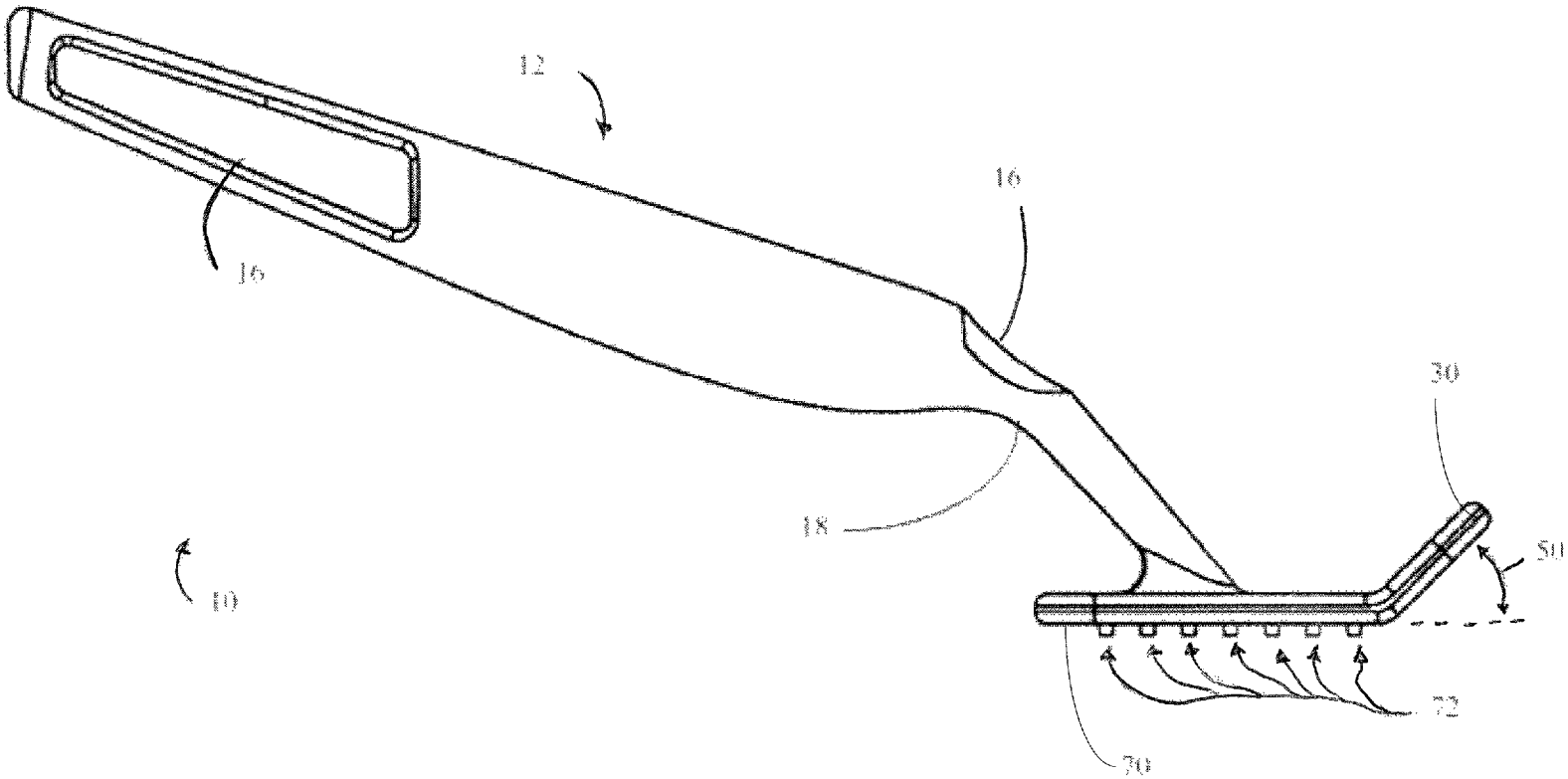
FIG. 3 depicts a side view of the cleaning tool.

FIG. 3 shows slotted member 30 oriented at an angle 50 relative to a bottom plane 70 of pad assembly 14. In the present example, the angle 50 is approximately 45 degrees. However, angle 50 can be more than 45 degrees or less than 45 degrees. For example, angle 50 may range from about 20 degrees to about 70 degrees. The angle 50 of slotted member 30 provides clearance for a cleaning pad (not shown) to be inserted into the slotted member 30 between the arm member 38 and the base member 42, and wrap around to the bottom plane 70 of pad assembly 14. Angle 50 also yields a surface raised from bottom plane 70 that helps a user better scrub concave surfaces. Additionally, wrapping a cleaning pad (not shown) around to the bottom plane 70 of pad assembly 14, with a portion of the cleaning pad (not shown) inserted into slotted member 30 can create a pressure on the cleaning pad (not shown) in the slotted member 30 between the arm member 38 and the base member 42, which can further secure the cleaning pad (not shown) in slot 32 in multiple normal orientations of the cleaning tool 10.

Figure 4:
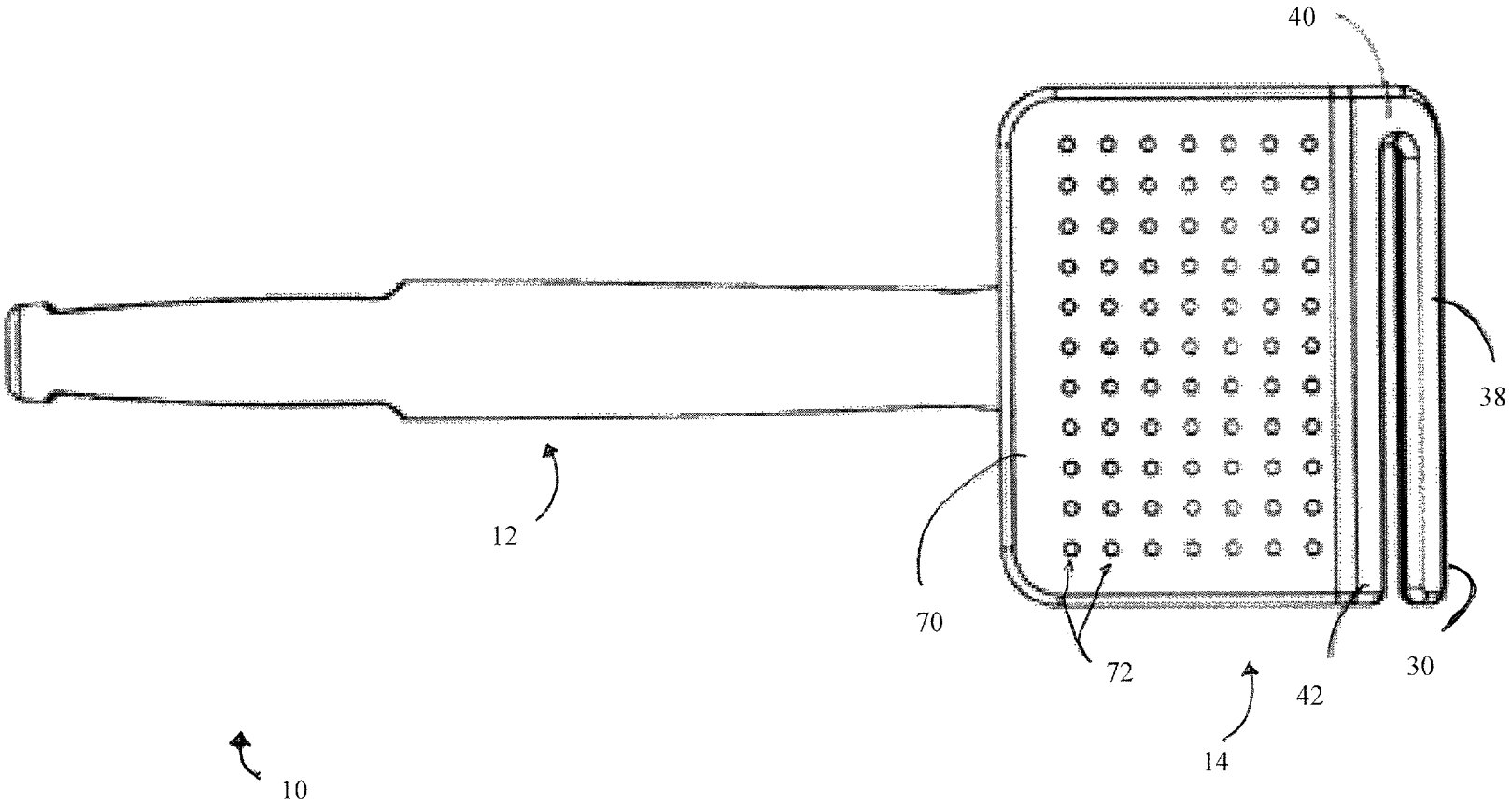
FIG. 4 depicts a bottom view of the cleaning tool.

FIGS. 3 and 4 show a plurality of pad securing members 72 projecting from the bottom plane 70 of pad assembly 14, along a perpendicular axis. In one example, a grid pattern of 7 by 11 pad securing members 72 is shown, but any suitable formation of pad securing members 72 may be used. The bottom plane 70 of pad assembly can also have more or less than the number of pad securing members 72 shown in FIG. 3. Moreover, pad securing members 72 need not even be in a particular pattern, as they may be dispersed randomly on the bottom plane 70 of pad assembly 14.

Figure 5:
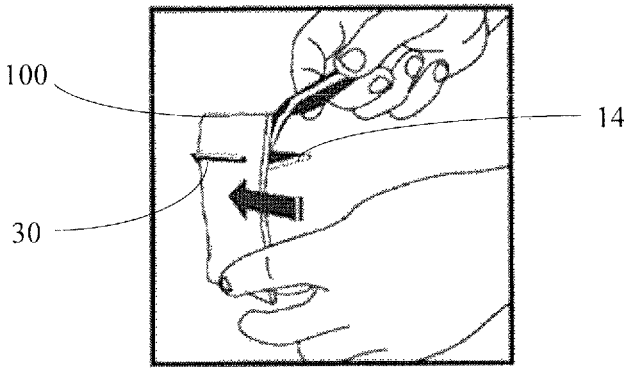
FIG. 5 is a schematic view showing a cleaning pad being installed into the cleaning tool.
Figure 6:
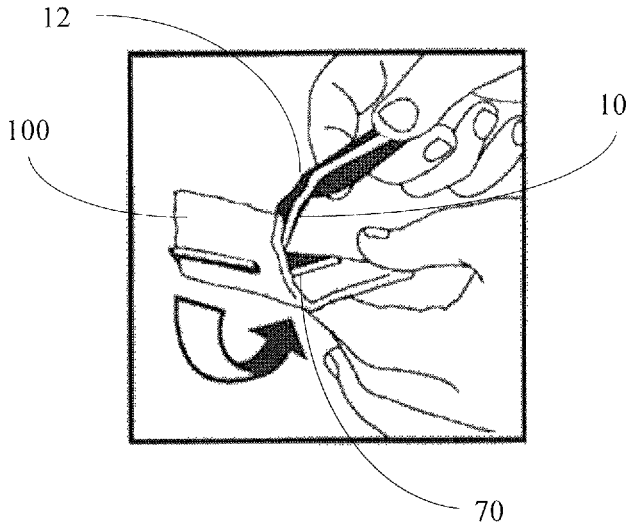
FIG. 6 is a schematic view showing the cleaning tool being prepared for use.
Figure 7:
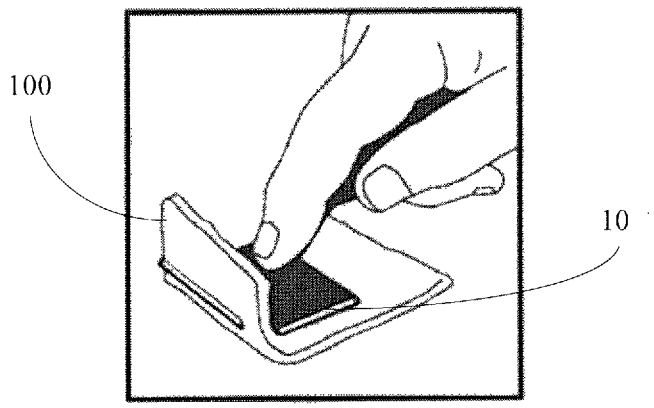
FIG. 7 is a schematic view showing a possible operation of the cleaning tool.

In the present example, pad securing members 72 are generally cylindrical in shape. Other examples may include pad securing members 72 of other shapes such as rectangular prisms, hexagonal prisms, tetrahedra or any other suitable shape. Pad securing members 72 are also shown as having a certain size relative to pad assembly 14. In other examples, pad securing members 72 may be smaller or larger relative to pad assembly 14. In one example plane 70 can have dimensions of about 5.7 cm by about 3.8 cm. Pad securing members 72 can have a diameter of about 1 mm to about 4 mm. Additionally, pad securing members 72 can extend substantially perpendicular from bottom plane 70 for a defined length. The length of the pad securing members 72 can be a percentage of the thickness of a cleaning pad (not shown). In one embodiment, the length of the pad securing members can be about 25% to about 50% of the thickness of the cleaning pad (FIGS. 5-7). Alternatively, the length of the pad securing members 72 can be determined to prevent the pad securing members 72 from extending through the cleaning pad (not shown) during use. Various other suitable sizes will be obvious to those with ordinary skill in the art.

FIGS. 3 and 4 depict pad securing members 72 of a uniform size and shape. However, it is important to understand that other embodiments may have pad securing members 72 that vary in size and shape across the bottom plane 70 of pad assembly 14. Moreover, the distribution of differently sized and shaped pad securing members 72 may be completely random or may consist of alternating groups of similarly sized and shaped pad securing members 72.

Pad securing members 72 can penetrate partially into non-woven cleaning pad when a downward pressure provided by a user compresses the non-woven cleaning pad between the bottom plane 70 and a generally parallel surface. This penetration by the pad securing members 72 can prevent or substantially reduce lateral and longitudinal shifting of the cleaning pad (not shown) relative to bottom plane 70 while a surface is being scrubbed. Additionally, the configurations of the pad securing members 72 can allow for a cleaning pad (not shown) to be easily lifted off from the pad securing members 72 in the transverse direction which is perpendicular to the bottom plane 70 of the pad assembly 14. Pad securing members 72 press against the back of the pad with a pressure point at the end of each pad securing member 72, but do not necessarily have barbs or other capturing means that inhibit the pad from lifting off of the pad securing members 72.

FIGS. 5-7 provide schematic illustrations of one embodiment of using a cleaning tool 10. In FIG. 5, cleaning pad 100 can first be installed into slotted member 30 as described above. The cleaning pad 100 can be larger than the pad assembly 14 in both the longitudinal and latitudinal axis (for example, 1.5 to 3 times larger). In the embodiment illustrated, the pad is 10.2 cm long by 6.5 cm wide. In one example, the cleaning pad 100 can have a surface area about 2.5 times larger than the surface area of bottom plane 70. This can allow the non-woven cleaning pad to be positioned in the pad assembly 14 initially, and then repositioned in the pad assembly 14 such that different portions of the cleaning pad 100 can be placed directly under the bottom plane 70 of the pad assembly 14 by the user. This can allow the user to place an unused portion of the cleaning pad 100 under the bottom plane 70 when the portion of the cleaning pad 100 previously under then bottom plane 70 becomes worn. This technique can also be used when the portion of the cleaning pad 100 under the bottom plane 70 becomes dirty, such that trapped particulates in the cleaning pad 100 could result in damaging a surface to be cleaned. The tool 10 also allows the pad to be easily removed and turned over to use the opposite side for cleaning, as well.

FIG. 6 shows a user bending cleaning pad 100 towards the handle assembly 12 and along bottom plane 70 where the cleaning pad 100 can interface with pad securing members 72 (not shown). FIG. 7 shows a user using cleaning tool 10 with cleaning pad 100. Cleaning pad 100 can be compressed between cleaning tool 10 and a surface (not shown) to be cleaned when a user presses downward on the cleaning tool 10, towards the surface to be cleaned (not shown).

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of the structure and operation show and described in the specification and drawings.

What is claimed is:

1. A cleaning tool comprising:

a handle assembly;

a pad assembly coupled to the handle assembly such that the handle assembly extends distally beyond a first end of the pad assembly, the pad assembly comprising:

a pad securing surface having a plurality of pad securing members extending substantially perpendicularly from the pad securing surface; and a slotted member located at a second end of the pad assembly, the second end being opposite the first end, the slotted member defining a slot configured to accept a cleaning pad, wherein the slotted member extends at an angle from the pad securing surface, and wherein the slotted member includes an arm member, a base member, and a transverse member, the transverse member extending along an axis substantially perpendicular to an axis of the base member and the arm member.

2. The cleaning tool of claim 1, wherein the slot is defined by the arm member, the base member and the transverse member.

3. The cleaning tool of claim 2, wherein the slot includes an open end at one side of the pad assembly and a closed end at an opposite side of the pad assembly, the closed end being defined by the transverse member.

4. The cleaning tool of claim 1, wherein the angle at which the slotted member extends from the pad securing surface is about 20 degrees to about 70 degrees.

5. The cleaning tool of claim 1, wherein the plurality of pad securing members are substantially cylindrical.

6. The cleaning tool of claim 1, wherein the handle assembly and the pad assembly are a single molded component.

7. The cleaning tool of claim 1, further comprising a pad, wherein the pad is larger than the pad assembly.

8. A cleaning tool comprising:

a handle assembly;

a pad assembly, wherein the pad assembly is coupled to the handle assembly such that the handle assembly extends distally beyond a first end of the pad assembly, the pad assembly comprising:

a pad securing surface having a plurality of pad securing members extending substantially perpendicularly from the pad securing surface;

a slotted member located at a second end of the pad assembly, the slotted member extending at an angle from the pad securing surface; and wherein the slotted member includes a slot configured to accept a cleaning pad, the slot includes an open end at a first side of the tool and a closed end at a second opposite end of the tool, and wherein the slotted member includes an arm member, a base member, and a transverse member, the transverse member extending along an axis substantially perpendicular to an axis of the base member and the arm member.

9. The cleaning tool of claim 8, further comprising a pad, wherein the pad is larger than the pad assembly.

10. A cleaning tool comprising:

a handle assembly;

a pad assembly, wherein the pad assembly is coupled to the handle assembly such that the handle assembly extends from a top side of the pad assembly, the pad assembly comprising:

a pad securing surface on a bottom side of the pad assembly having a plurality of pad securing members extending substantially perpendicularly from the pad securing surface;

a slotted member located at a first end of the pad assembly, the slotted member extending at an angle from the pad securing surface; and wherein the slotted member includes a slot configured to accept a cleaning pad, the slot includes an open end at a first side of the tool and a closed end at a second opposite side of the tool, and wherein the slotted member includes an arm member, a base member, and a transverse member, the transverse member extending along an axis substantially perpendicular to an axis of the base member and the arm member.

11. The cleaning tool of claim 10, wherein the handle assembly further extends beyond a second end of the pad assembly, the second end being opposite from the first end.

12. The cleaning tool of claim 10, further comprising a pad, and wherein the pad is 1.5 to 3 times larger in area than the pad securing surface.

* * * * *